US006969055B1

(12) United States Patent
Schwind

(10) Patent No.: US 6,969,055 B1
(45) Date of Patent: Nov. 29, 2005

(54) COVE BASE MOLDING CLAMP

(76) Inventor: Carl L. Schwind, 3121 W. Pawnee, Wichita, KS (US) 67217

( * ) Notice: Subject to any disclaimer, the term of this patent is extended or adjusted under 35 U.S.C. 154(b) by 8 days.

(21) Appl. No.: 10/833,868

(22) Filed: Apr. 28, 2004

(51) Int. Cl.[7] ..... B23Q 3/02
(52) U.S. Cl. ..... 269/91; 254/11
(58) Field of Search ..... 269/91–95, 76, 269/71, 97, 902; 254/11

(56) References Cited

U.S. PATENT DOCUMENTS

| | | | | |
|---|---|---|---|---|
| 327,171 | A | 9/1885 | Ingham | |
| 581,167 | A | 4/1897 | Mengert | |
| 797,245 | A | 8/1905 | Wallum | |
| 2,606,743 | A * | 8/1952 | Owens | 254/212 |
| 2,869,244 | A | 1/1959 | Dipert | |
| 3,524,623 | A | 8/1970 | Campbell | |
| 3,747,157 | A | 7/1973 | Szymanski | |
| 4,538,846 | A | 9/1985 | Alexander | |
| 5,617,698 | A | 4/1997 | Guilmette | |
| 5,683,526 | A | 11/1997 | Guilmette et al. | |
| 5,855,361 | A * | 1/1999 | Krowchak | 254/209 |
| 5,964,450 | A * | 10/1999 | Pasto | 254/11 |
| 6,233,882 | B1 | 5/2001 | Breaux | |
| 6,418,696 | B1 | 7/2002 | Swingle | |
| 6,419,207 | B1 | 7/2002 | Barry et al. | |

* cited by examiner

*Primary Examiner*—Lee D. Wilson
(74) *Attorney, Agent, or Firm*—Kenneth H. Jack; Davis & Jack, LLC

(57) ABSTRACT

A cove base molding clamp consisting of a carpet engaging fulcrum, a lever arm having proximal and distal ends, the proximal end of the lever arm being fixedly attached to the carpet engaging fulcrum; a driving arm having a proximal and a distal end, the proximal end of the driving arm being fixedly attached to the carpet engaging fulcrum; a carpet engaging foot; a jack screw interconnecting the carpet engaging foot and the distal end of the lever arm, the jack screw being adapted for alternately downwardly extending the carpet engaging foot from the lever arm and upwardly retracting the carpet engaging foot toward the lever arm; and a molding engaging head fixedly attached to or formed wholly with the distal end of the driving arm.

9 Claims, 3 Drawing Sheets

COVE BASE MOLDING CLAMP

FIELD OF THE INVENTION

This invention relates to carpet flooring and wall trim installation tools. More particularly, this invention relates to tools and apparatus adapted for clamping or compressively applying flexible vinyl cove base moldings to wall surfaces at floor level.

BACKGROUND OF THE INVENTION

Where lengths of flexible vinyl cove base molding are applied by gluing to 90° outside corner wall surfaces, such moldings tend to elastically resist sharp bending at such corner and tend to cause the inner adhesion surfaces of such moldings to outwardly arcuately curve away from the wall surfaces at the corners. Such moldings' elastic resistance to sharp 90° bending commonly frustrates and prevents glue adhesion at the wall corner surfaces, undesirably resulting in an unsightly cove base molding installation.

Heavy objects such as bricks placed in an angled resting manner against the cove base molding at such corners are known to be utilized to attempt to achieve close adhesion at outside wall corners. However, utilization of such heavy objects typically provides deficient lateral pressing force, resulting in deficient glue adhesion contact. Known mechanical cove base molding clamps such as are disclosed in U.S. Pat. No. 6,419,207 issued Jul. 16, 2002, to Barry, et al., overcome some of the problems discussed above relating to placement of heavy objects against cove base molding. However, such clamps are undesirably mechanically complex, they are not economically fabricated, and such clamps undesirably tend to urge or push cove base moldings upwardly along a wall surface and out of position before glues dries.

The instant inventive cove base molding clamp solves or ameliorates the problems and deficiencies of prior art molding clamps and presses discussed above by providing a mechanically simple and economically fabricated tool which incorporates carpet engaging lever and wall pressing arms, such tool being capable of securely pressing plastic cove base moldings against cornered or flat wall surfaces while simultaneously driving such molding downwardly against carpeting as opposed to upwardly away from carpeting.

BRIEF SUMMARY OF THE INVENTION

The instant inventive cove base molding clamping tool preferably comprises a lever arm, a cove base molding driving arm, and a carpet engaging fulcrum.

Preferably, the carpet engaging fulcrum comprises an inverted length of carpet tack stripping which serves as a laterally rightwardly and leftwardly extending "T" bar. The preferred length of the "T" bar carpet tack strip is approximately six inches, and such strip is preferably oriented so that the natural cant or angle of the strip's tacks or pins extend the pins downwardly and rearwardly. Suitably, the carpet engaging fulcrum may comprise other types of crossbars, plate structures, or mounting structures which are capable of supporting and downwardly extending carpet engaging at least a first and preferably a plurality of pins, nails, tacks, hooks, teeth, and the like.

The lever arm of the instant invention preferably has a proximal end fixedly attached to or formed wholly with the carpet engaging fulcrum, and the lever arm preferably has a distal end extending rearwardly from the carpet engaging fulcrum.

The molding driving arm of the instant invention preferably has a proximal end fixedly attached to or formed wholly with the carpet engaging fulcrum, and the molding driving arm has a distal end, the distal end of the molding driving arm preferably extending forwardly and upwardly from the carpet engaging fulcrum.

Preferably, for purposes of mechanical simplicity and economy in fabrication, the lever arm and the molding driving arm are wholly formed of a single block of pine wood of injection molded plastic, the preferred tack strip carpet engaging fulcrum or "T" bar being glued and attached by a screw to an undersurface of such block.

A molding engaging head is preferably fixedly attached to or formed wholly with the distal end of the driving arm. Preferably, the molding engaging head comprises a vertically extending 90° "V" channel for pressing cove base moldings against outside 90° corner wall surfaces. Preferably, the molding engaging head further comprises left and right forwardly facing flat contact surfaces for pressing moldings into concavities within flat wall surfaces. The molding engaging head may comprise a separately attached component. However, for purposes of mechanical simplicity and economy in fabrication, the molding engaging head preferably comprises specifically cut or molded surfaces of the distal end of the driving arm.

A carpet engaging foot and foot attaching means are preferably provided, the foot attaching means being adapted for alternately downwardly extending the carpet engaging foot from the rearward or distal end of the lever arm and upwardly retracting such foot toward the lever arm. Preferably, the carpet engaging foot and foot attaching means comprises a jack screw assembly. Suitably, such means and foot may alternately comprise rotatable cams, ratchet extendable shafts, sliding wedge assemblies or other commonly known article extending and retracting mechanisms.

In use of the instant inventive cove base molding clamping tool, and assuming a preferred configuration of the tool as set forth above, such tool is placed upon a carpet surface in close proximity with cove base molding positioned for glued application to, for example, an outside wall corner. Thereafter, the jack screw is operated to downwardly extend the carpet engaging foot. As the foot extends downwardly, the jack screw levers the lever arm upwardly and forwardly causing the pins of tack strip to downwardly and rearwardly dig into the carpet while simultaneously causing the driving arm to laterally and downwardly press the molding engaging head against cove base molding at the corner. Such levering and driving actions advantageously drive the molding laterally against the corner and slightly downwardly. Any downward shifting of the molding is advantageously stopped by contact of the normally flared lower edge of the molding with the carpet surface. The assembly described is maintained until the glue become sufficiently tacky to hold at the corner with the clamp. Thereafter, the clamping tool is removed through a reversal of the steps outlined above.

Accordingly, objects of the instant invention include provision of a cove base molding clamp having a carpet engaging fulcrum, a lever arm, and a driving arm, such clamp being capable of providing a forward and downward clamping force to cove base moldings.

Further objects include provision of the cove base molding clamp which is mechanically simple and is economically fabricated.

Other and further objects, benefits, and advantages of the present invention will become known to those skilled in the art upon review of the Detailed Description which follows, and upon review of the appended drawings.

DETAILED DESCRIPTION OF A PREFERRED EMBODIMENT

Figure 1:
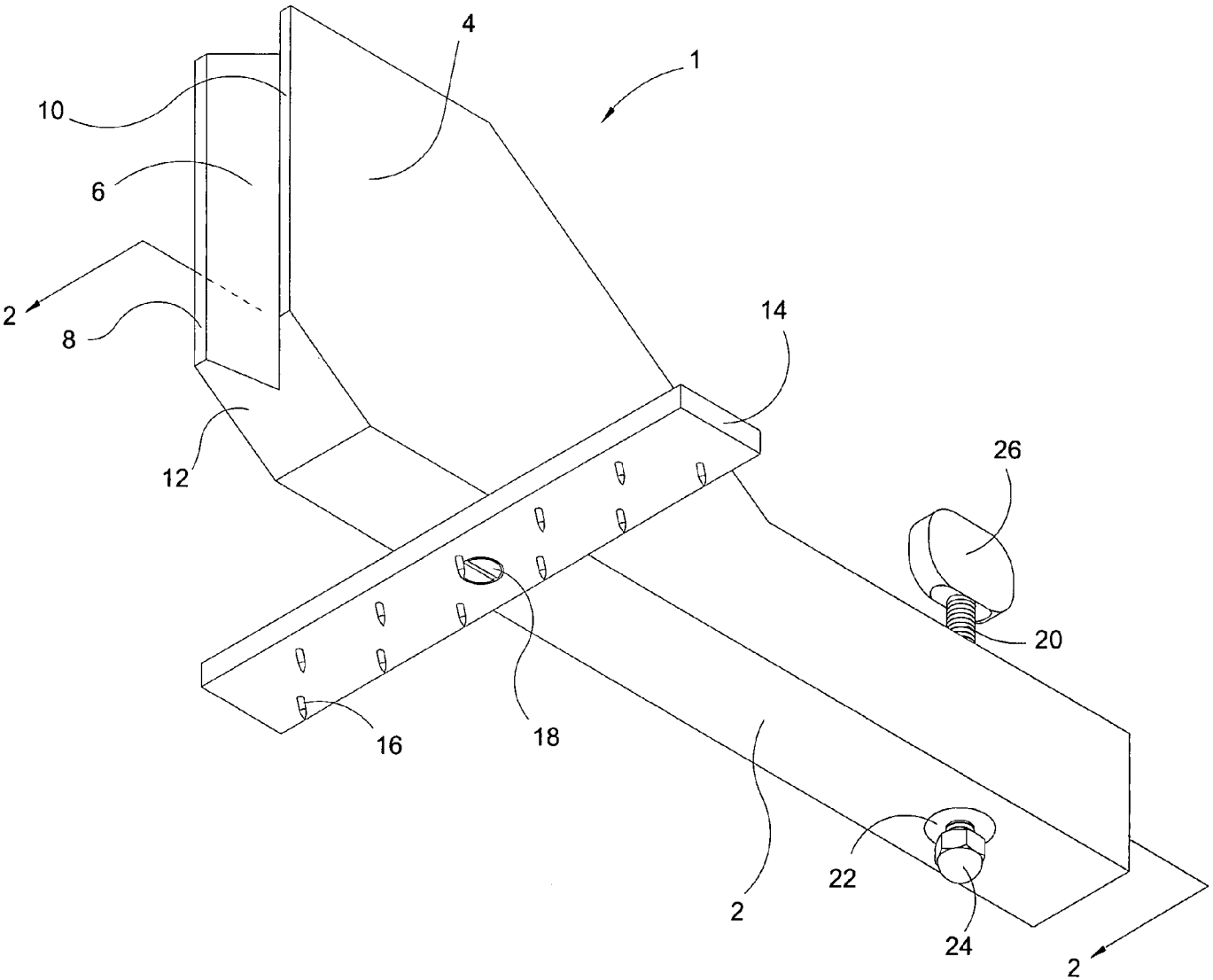
FIG. 1 is an isometric view of a preferred embodiment of the instant inventive cove base molding clamp.
Figure 2:
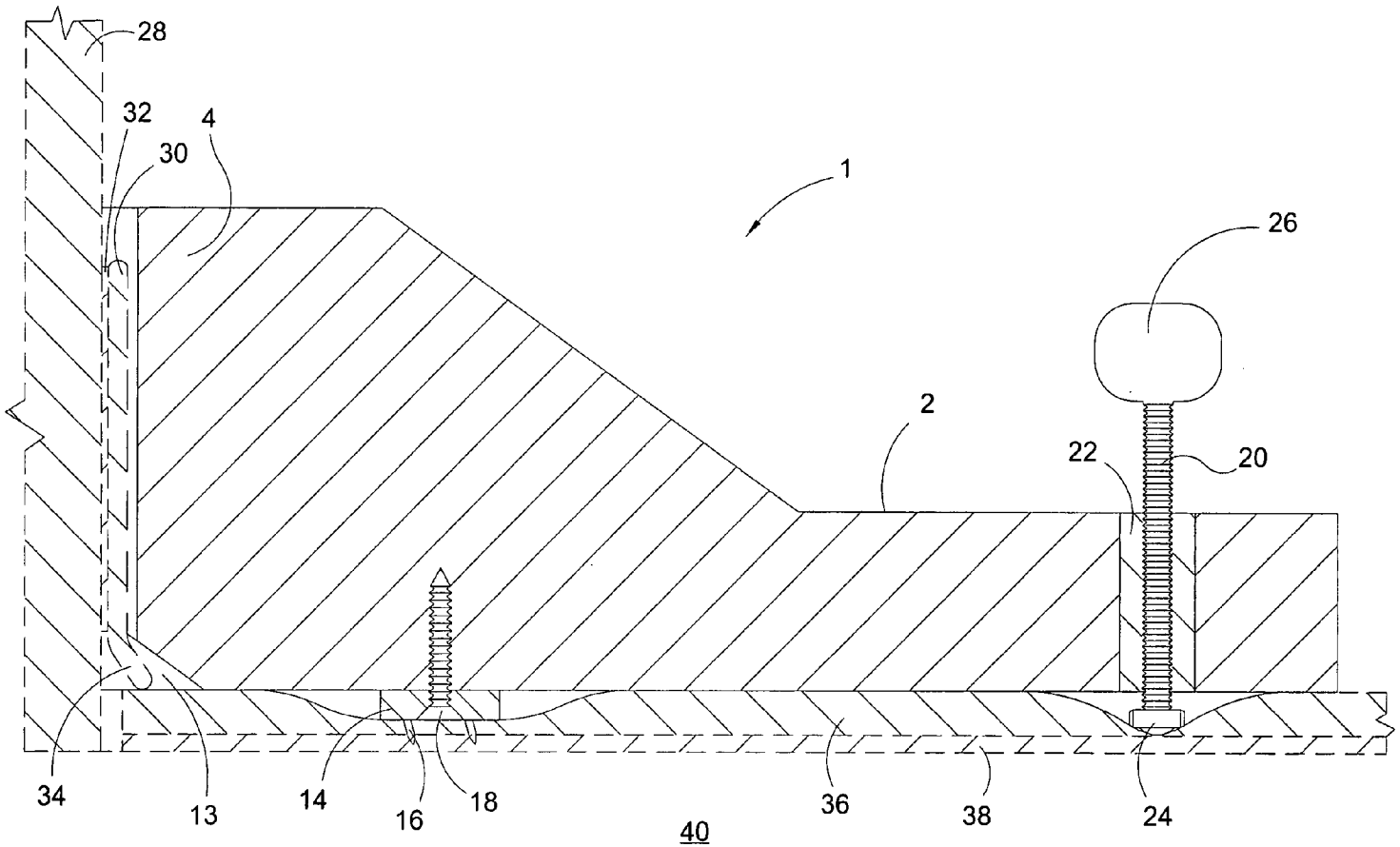
FIG. 2 is a sectional view as indicated in FIG. 1, the view showing the tool in use upon flexible cove base molding adhesively installed upon a wall outside 90° corner and over carpeting.
Figure 3:
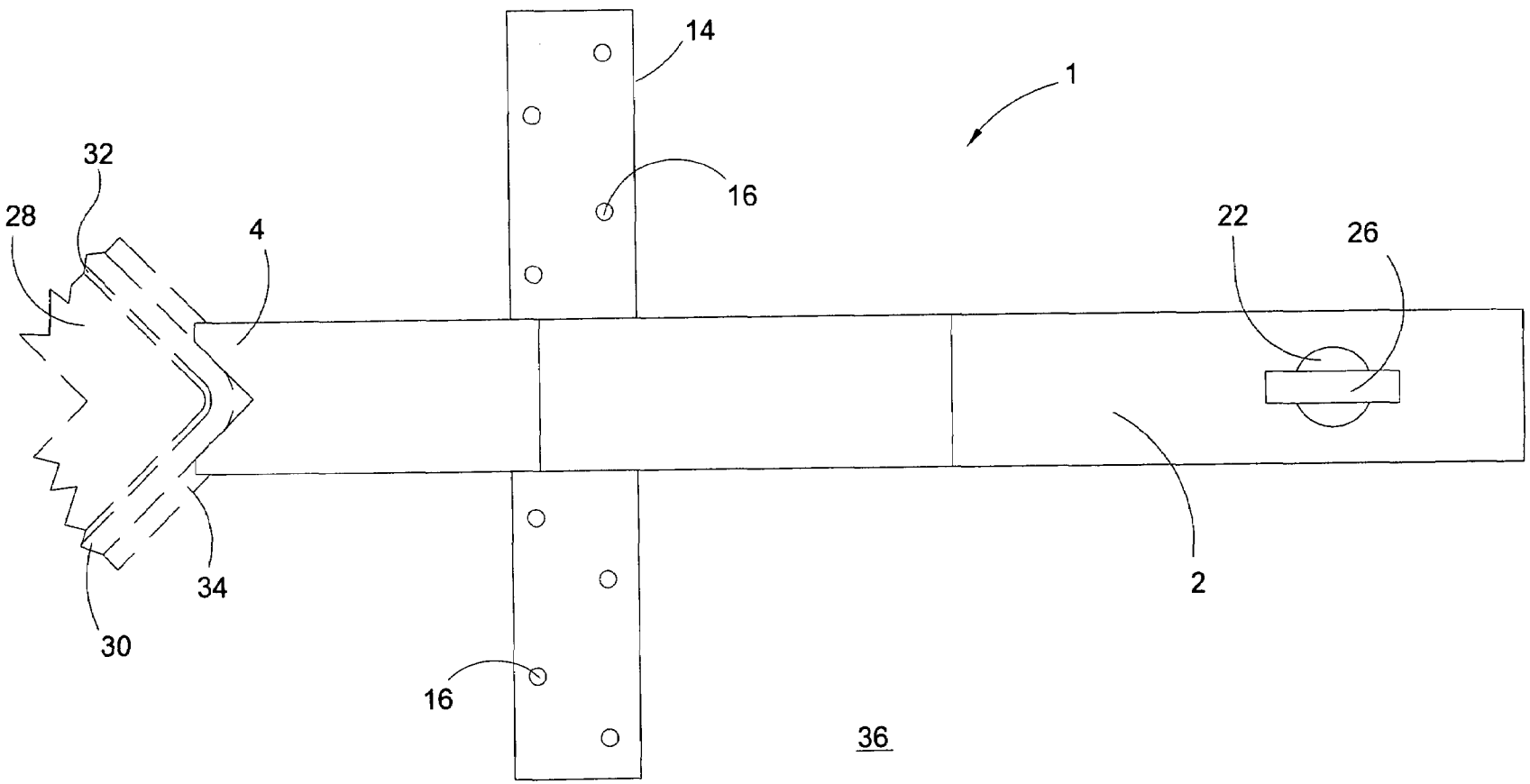
FIG. 3 is a plan view, showing the clamp representationally in use as depicted in FIG. 2.

Referring now to the drawings, and in particular to FIG. 1, the instant inventive cove base molding clamping tool is referred to generally by Reference Arrow 1. The body of the cove base molding clamping tool 1 preferably comprises a wooden or plastic injection molded block having a rearwardly extending lever arm 2, and having an upwardly and forwardly extending molding driving arm 4. A carpet tack strip 14 having downwardly and rearwardly extending pins or tacks 16 preferably forms a "T" bar attachment located at the proximal ends of the driving and lever arms 2 and 4, such attachment preferably incorporating a helically threaded screw 18, and glue. The laterally extending "T" bar advantageously provides enhanced carpet gripping, provides resistance against lateral tipping of the clamp, and provides resistance against rotational slippage of the clamp about a vertical axis.

Referring further to FIG. 1, a carpet engaging foot preferably comprising a domed cap nut 24 is preferably downwardly extendably and upwardly retractably mounted upon the rearward end of lever arm 2 by means of a helically threaded shaft 20, such shaft being threadedly received by a helically threaded insert sleeve 22. A thumb turn plate 26 is preferably fixedly attached to or formed wholly with the upper end of helically threaded shaft 20. Clockwise rotation of thumb turn 26 drives foot 24 downwardly away from lever arm 2 and into a carpet surface while counter clockwise rotation of thumb turn 26 upwardly withdraws foot 24.

The forward or distal end of driving arm 4 preferably forms a molding engaging head comprising a vertically extending 90° "V" channel 6, such channel preferably being leftwardly and rightwardly bordered by compression faces 8 and 10. Preferably, the lower end of the "V" channel 6 and driving arm 4 is back cut, forming a molding flare clearing bevel 12.

In use of the inventive cove base molding clamping tool 1, referring simultaneously to all figures, a layer of contact adhesive glue 32 is applied to the inner surface of a length of flexible vinyl cove base molding 30, having a carpet contact flare 34. Thereafter, the cove base molding 30 is positioned, for example, against an outside wall 90° corner 28. Thereafter, an operator grasps clamp 1 with one hand and presses the clamp 1 and tack strip 14 downwardly against carpet 36 while orienting and laterally pressing the "V" channel 6 so that its faces substantially completely press cove base molding 30 against the dual surfaces of corner 28. Such downward pressure preferably extends tacks or pins 16 through the carpet pile layer of carpet 36 to engage the carpet's backing layer 38.

Thereafter, the operator utilizes his other hand to turn thumb turn plate 26 clockwise, operating the threaded shaft 28 and threaded insert 22 to downwardly extend foot 24. The downward extension of foot 24 levers lever arm 2 upwardly causing the faces of "V" channel 6 to forcefully press forwardly and slightly downwardly against cove base molding 30, while causing tacks 16 to dig into and securely engage the backing layer 38 of carpet 36. Upon drying of glue 32, reversal of steps described above removes the cove base molding clamp tool 1.

Alternately, where a flat wall surface includes a concave depression, which commonly tends to locally frustrate glue adhesion, the clamp 1 may be utilized against such wall surface at such concavity, causing faces 8 and 10 to forcefully press the cove base molding into the concavity for complete adhesion of the molding.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A cove base molding clamp comprising:

(a) a carpet engaging fulcrum;

(b) a lever arm having proximal and distal ends, the proximal end of the lever arm being fixedly attached to or formed wholly with the carpet engaging fulcrum;

(c) a driving arm having a proximal end and a distal end, the proximal end of the driving arm being fixedly attached to or formed wholly with the carpet engaging fulcrum;

(d) a carpet engaging foot;

(e) foot attaching, extending, and retracting means interconnecting the carpet engaging foot and the distal end of the lever arm, the foot attaching, extending, and retracting means being adapted for alternately downwardly extending the carpet engaging foot from the lever arm and upwardly retracting the carpet engaging foot toward the lever arm; and (f) a molding engaging head fixedly attached to or formed wholly with the distal end of the driving arm; the carpet engaging fulcrum further comprising a "T" bar and a plurality of pins extending downwardly from the "T" bar, each pin among the plurality of pins being canted rearwardly.

2. The cove base molding clamp of claim 1 wherein the "T" bar and pins combination consists of a carpet tack strip.

3. A cove base molding clamp comprising:

(a) a carpet engaging fulcrum;

(b) a lever arm having proximal and distal ends, the proximal end of the lever arm being fixedly attached to or formed wholly with the carpet engaging fulcrum;

(c) a driving arm having a proximal end and a distal end, the proximal end of the driving arm being fixedly attached to or formed wholly with the carpet engaging fulcrum;

(d) a carpet engaging foot;

(e) foot attaching, extending, and retracting means interconnecting the carpet engaging foot and the distal end of the lever arm, the foot attaching, extending, and retracting means being adapted for alternately downwardly extending the carpet engaging foot from the lever arm and upwardly retracting the carpet engaging foot toward the lever arm; and (f) a molding engaging head fixedly attached to or formed wholly with the distal end of the driving arm; the foot attaching, extending, and retracting means comprising a jack screw.

4. The cove base molding clamp of claim 3 wherein the jack screw has an upper end extending upwardly from the lever arm and further comprising a thumb turn fixedly attached to or formed wholly with the upper end of the jack screw.

5. A cove base molding clamp comprising:

(a) a carpet engaging fulcrum;

(b) a lever arm having proximal and distal ends, the proximal end of the lever arm being fixedly attached to or formed wholly with the carpet engaging fulcrum;

(c) a driving arm having a proximal end and a distal end, the proximal end of the driving arm being fixedly attached to or formed wholly with the carpet engaging fulcrum;

(d) a carpet engaging foot;

(e) foot attaching, extending, and retracting means interconnecting the carpet engaging foot and the distal end of the lever arm, the foot attaching, extending, and retracting means being adapted for alternately downwardly extending the carpet engaging foot from the lever arm and upwardly retracting the carpet engaging foot toward the lever arm; and (f) a molding engaging head fixedly attached to or formed wholly with the distal end of the driving arm, the molding engaging head comprising a vertically extending "V" channel and left and right contact faces vertically bordering the "V" channel; the carpet engaging fulcrum further comprising a "T" bar, and a plurality of pins extending downwardly from the "T" bar.

6. The cove base molding clamp of claim 5 wherein each pin among the plurality of pins is canted rearwardly.

7. The cove base molding clamp of claim 6 wherein the "T" bar and pins combination consists of a carpet tack strip.

8. The cove base molding clamp of claim 7 wherein the foot attaching, extending, and retracting means comprises a jack screw.

9. The cove base molding clamp of claim 8 wherein the jack screw has an upper end extending upwardly from the lever arm and further comprising a thumb turn fixedly attached to or formed wholly with the upper end of the jack screw.

* * * * *